United States Patent [19]

Rickard

[11] 4,135,426

[45] Jan. 23, 1979

[54] STRINGED INSTRUMENT BRIDGE

[75] Inventor: James H. Rickard, Harwinton, Conn.

[73] Assignee: Ovation Instruments, Inc., New Hartford, Conn.

[21] Appl. No.: 760,737

[22] Filed: Jan. 19, 1977

[51] Int. Cl.[2] ..... G10H 3/00

[52] U.S. Cl. ..... 84/1.16; 84/298; 84/307; 84/310

[58] Field of Search ..... 84/1.16, 209, 267, 273, 84/297–302, 307–311

[56] References Cited

U.S. PATENT DOCUMENTS

| | | | |
|---|---|---|---|
| 2,565,253 | 8/1951 | Melita | 854/298 |
| 3,396,284 | 8/1968 | Scherer | 84/1.16 X |
| 3,440,917 | 4/1969 | Lemon | 84/310 |
| 3,443,467 | 5/1969 | Richards | 84/307 |
| 3,544,696 | 12/1970 | Broussard | 84/1.16 |
| 3,743,751 | 7/1973 | Ibanez | 84/1.16 |

FOREIGN PATENT DOCUMENTS

| | | | |
|---|---|---|---|
| 989398 | 4/1965 | United Kingdom | 84/310 |

*Primary Examiner*—Robert K. Schaefer

*Assistant Examiner*—Vit W. Miska

*Attorney, Agent, or Firm*—McCormick, Paulding & Huber

[57] ABSTRACT

A bridge for an electric string bass or other stringed musical instrument includes a base adapted for attachment to the body of the instrument and a number of saddles for individually supporting the strings, the saddles being adjustably movable to different positions relative to the base, in the direction along the length of the strings, to adjust the string intonation. The saddles may include piezoelectric elements for providing electrical signals and, in this case, the base may further include a covered recess for housing a plurality of volume controls each associated with a respective one of the strings. The saddles are designed and arranged on the base to support the strings with a given curvature matching that of the fret board and an adjustment means is provided for raising, lowering and/or tilting the base relative to the body to bring the strings into proper height adjustment relative to the frets. The bridge base also provides an easy-loading tailpiece for anchoring the adjacent ends of strings to the base and a housing for a mute mechanism located forwardly of the saddles.

11 Claims, 15 Drawing Figures

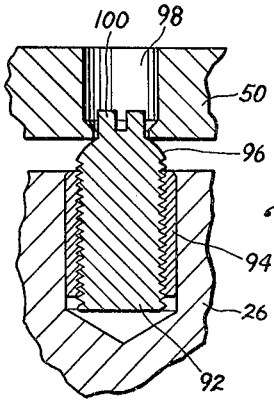
Fig. 7
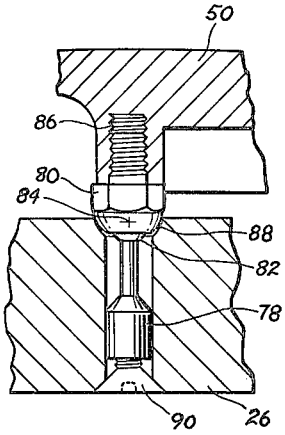
Fig. 8
Fig. 9
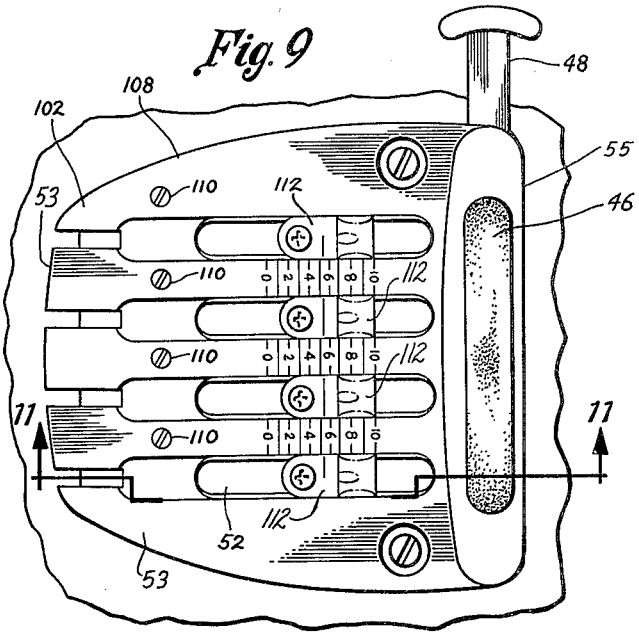
Fig. 10
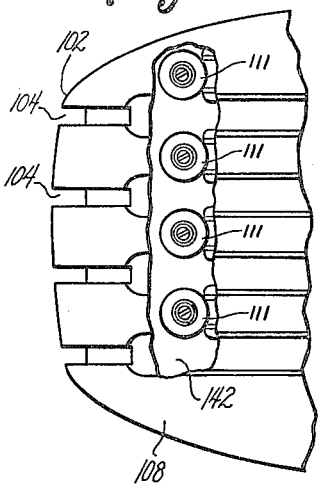
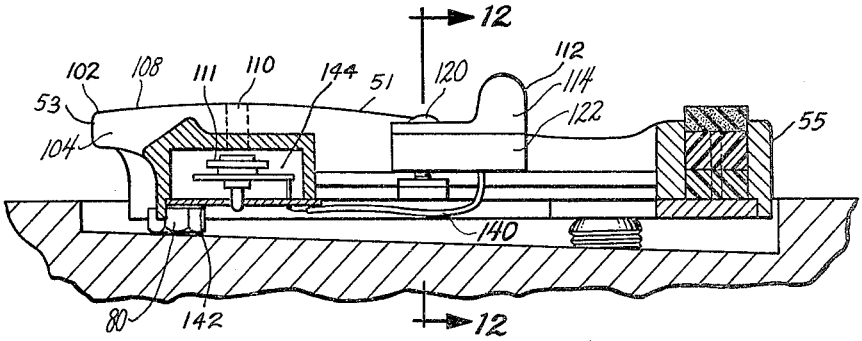
Fig. 11

STRINGED INSTRUMENT BRIDGE

BACKGROUND OF THE INVENTION

This invention relates to stringed musical instruments, and deals more particularly with a bridge for such an instrument which bridge may be combined with a tailpiece and/or a mute mechanism to form a single unit.

The invention is advantageously applied to an electric string bass and is, therefore, in the accompanying drawings and following description illustrated and described in such environment. However, it may be applied to a large variety of other stringed instruments and there is no intention to limit the invention to the illustrated example.

In stringed musical instruments of the type with which this invention is concerned, the strings are conventionally stretched between a bridge and a nut and along part of the distance between the bridge and the nut are underlain by a fret board against which they may be pressed in the playing of the instrument to change their respective lengths and therefore the frequency of the sounds produced. It is further known that due to different characteristics of different strings, different strings require slightly different spacings between the bridge and the nut to produce accurate intonation from the strings as the string is pressed against different frets of the fret board. Not only do the several strings of the set of strings installed on an instrument commonly require different bridge to nut spacings but any given string of such set also commonly requires different bridge to nut spacings depending on its brand. Therefore, a general object of this invention is to provide a bridge wherein the bridge to nut spacing of the individual strings may be readily adjusted. In further keeping with this object, a more specific object is to provide a bridge wherein individually adjustable support means are provided for each string and wherein a visible indication is provided for each such support member to indicate its particular state of adjustment whereby the positions of the string support members may be visually set to agree with a pre-established setting scheme associated with the brand of strings used on the instrument, thereby eliminating the need for a performer to adjust the string intonation by ear or at least giving initial coarse adjustments from which finer adjustments can then be made by ear.

A further object of this invention is to provide a bridge of the foregoing character wherein the string support members are supported on their base so as to provide a fixed string curvature matching the curvature of the fret board and including an adjustment means whereby the base of the bridge may be raised and lowered and/or tilted relative to the body of the instrument to bring the strings into proper height adjustment relative to the fret board without changing the curvature established by the string support members.

Another object of the invention is to provide a bridge such as aforesaid whose base also provides a tailpiece for anchoring the adjacent ends of the strings to the base and which tailpiece is designed to permit quick loading and unloading of the strings to facilitate their installation and removal from the instrument.

A still further object of this invention is to provide a bridge of the foregoing character whose base also serves to provide a housing for a mute located slightly forwardly of the string supporting members of the bridge and movable into and out of engagement with the strings and which mute therefore moves with the base as the base is adjusted so as to retain the same relationship with said strings despite adjustment of said base relative to said body.

A further object of the invention is to provide an electrical output for each string by providing a piezoelectric element in each string supporting member to produce an electrical output signal analogous to the vibration of the string supported thereby. In connection with this object, a more detailed object of the invention is to provide the bridge base with a recess providing a covered housing for a plurality of volume controls each associated with a respective one of the piezoelectric elements.

A still more specific object of the invention is to provide a bridge for a stringed musical instrument which bridge is combined with a tailpiece and a mute to provide a single bridge, tailpiece and mute unit adapted for attachment to an instrument body.

Other objects and advantages of the invention will be apparent from the following description and from the drawings forming a part thereof.

SUMMARY OF THE INVENTION

The invention resides in a bridge for a stringed musical instrument with the bridge having a base adapted for attachment to the body of the instrument and with the base having a plurality of parallel elongated bridge slots therein arranged side by side and receiving a plurality of saddles each slidably received in a respective one of the slots for movement along its length. Each of the saddles has a portion extending out of its associated slot for supporting a respective one of the instrument strings, and an adjustment means is provided for releasably fixing each of the saddles to the base in a given position of adjustment.

The invention also resides in the base rearwardly of the bridge slots having a rearwardly extending lip extending transversely of the bridge slots and itself having a plurality of string receiving slots, with open rear ends, aligned with the bridge slots for receiving and anchoring bead-ended strings to the base.

The invention also resides in the bridge base forwardly of the bridge slots having a transversely extending recess for receiving a mute movable relative to the base into and out of engagement with the strings supported by the bridge saddles.

The invention also resides in the base for the bridge having an associated means for supporting the base from the body of the instrument whereby the base may be adjusted to raise and lower the bridge saddles and/or to tilt the base about an axis parallel to the strings to adjust the height of the strings relative to the fret board of the instrument.

Still further, the invention resides in the saddles of the bridge including piezoelectric elements, and in the particular design of the saddles to accommodate such elements, to produce an electrical output signal for each string, and it further resides in the base of the bridge having a recess housing volume controls associated with the piezoelectric elements.

BRIEF DESCRIPTION OF THE DRAWINGS

FIG. 7 is a fragmentary sectional view taken on the line 7—7 of FIG. 2.

FIG. 8 is a fragmentary sectional view taken on the line 8—8 of FIG. 2.

FIG. 9 is a plan view of a combined bridge, tail-piece and mute unit embodying an alternative form of the invention.

FIG. 10 is a view of a portion of FIG. 9 with part of the base of the unit being shown broken away to reveal the volume control potentiometers.

FIG. 11 is a longitudinal sectional view taken on the line 11—11 of FIG. 9.

DETAILED DESCRIPTION OF THE PREFERRED EMBODIMENTS

The set of figures consisting of FIGS. 1 to 8 illustrate the invention embodied in a combined bridge, tail-piece and mute unit 20 having no pickup means for providing an electrical output signal or signals related to string vibration. The set of figures consisting of FIGS. 9 to 15, on the other hand, illustrate the invention embodied in another combined bridge, tailpiece and mute unit 22 including an electrical pickup means. Various corresponding parts of the unit 20 and the unit 22 are, however, identical to one another and where this is the case they have been given identical reference numbers in the two sets of figures.

Figure 1:
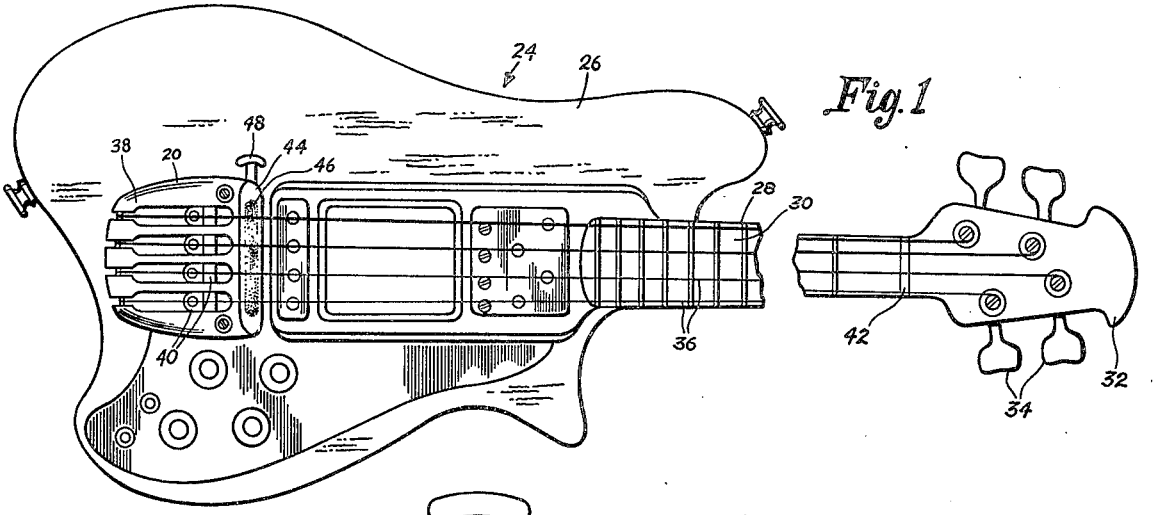
FIG. 1 is a fragmentary plan view of an electric string bass having a combined bridge, tailpiece and mute unit embodying this invention.

Referring first to FIGS. 1 to 8, and first considering FIG. 1, the tailpiece, bridge and mute unit 20 there illustrated is shown in use on an electric string bass, indicated generally at 24, having a solid wood body 26 and a neck 28 with fret board 30. At the outer end of the neck is a peg head 32 having four machine heads 34, 34 to which the four strings 36, 36 of the instrument are respectively attached. At their opposite ends, the strings are attached or anchored to a tailpiece section 38 of the unit 20. Also included in the unit 20 is a bridge section including four string supporting saddles 40, 40 over which the strings pass to a nut 42 at the outer end of the fret board 30. Forwardly of the saddles 40, 40 the unit 20 also includes a mute section 44 having a mute 46 movable upon shifting of a manually operable slide 48 into and out of contact with the strings 36, 36. The mute 46 and its associated operating mechanism is shown and described in detail in the U.S. patent application Ser. No. 760,735 of James H. Rickard filed Jan. 19, 1977 and entitled STRINGED INSTRUMENT MUTE MECHANISM and reference may be made to said application for further understanding of its structure and operation.

Considering now FIGS. 2 to 6, the unit 20 includes a base 50, preferably made of die cast aluminum or other metal, having a top surface 51, a rear end 53, and a forward end 55. It also has a plurality of parallel elongated bridge slots 52, 52 arranged side by side and each of which receives a respective one of the saddles 40. Each slot 52 is recessed inwardly from the top surface 51 and at its forward and rear ends terminates short of the forward and rear ends of the base. Each slot 52 further has a top portion 54, an intermediate portion 56 and a lower portion 58 each defined by two spaced side walls. The side walls of the top portion 54 and of the bottom portion 58 are spaced farther from one another than are the side walls of the intermediate slot portion 56 so that the intermediate portion 56 defines a pair of upwardly facing shoulders 60, 60 at the bottom of the top slot portion 54 and a pair of downwardly facing shoulders 62, 62 at the top of the bottom portion 58.

Each saddle 40 is of considerably shorter length than its slot 52, is partially received in the top portion 54 of its slot 52 and has two parallel side walls which slidably engage the side walls of the top slot portion to restrain the saddle to sliding movement along the length of the slot. Further, each saddle has a flat bottom surface 64 which rests on and slides along the two shoulders 60, 60 at the bottom of the top slot portion. Each saddle 40 further includes at one end an upwardly projecting string support portion 66 suitably grooved at its upper end to receive its associated string and also includes an arm portion 68 extending rearwardly of the portion 66 and apertured to loosely receive a screw 70 having an enlarged head adjacent the top surface of the arm portion 68, the head being slotted to receive a screw driver for loosening and tightening the screw.

At its lower end, each screw 70 is threadably received by a nut 72 at least a part of which is received in the bottom portion 58 of the associated slot. The nut has parallel side faces which engage the parallel side walls of the slot portion 58 to prevent the nut from turning and also has upwardly facing surfaces engaging the downwardly facing shoulders 62, 62. Therefore, when the screw 70 is tightened, the associated saddle 40 is fixed to the base as a result of the saddle 40 and nut 72 being held tightly by the screw against the shoulders 60, 60 and 62, 62. By loosening the screw, the saddle may be released from the base to permit it to be moved lengthwise of the string and along its slot to a different position of adjustment. From FIG. 2, it will be noted that each string 36 passes directly over its associated screw 70. However, when making an adjustment of the saddle 40, access to the head of the screw 70 can easily be gained by temporarily shifting the string off of the saddle to a position to one side of the screw.

Figure 4:
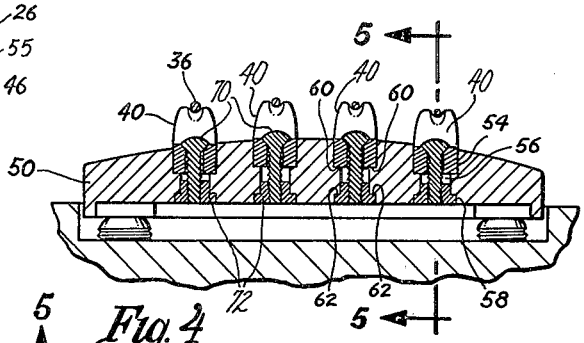
FIG. 4 is a transverse sectional view taken on the line 4—4 of FIG. 2.

As seen in FIG. 4, the four saddles 40, 40 define a given curvature for the strings at the bridge. Generally, this curvature is designed to match that of the fret board and need never be changed. However, if it is desired for some reason to change the curvature, this may readily be accomplished by substituting different saddles of different heights or by placing shims under the existing saddles.

The purpose of adjusting the position of the saddles 40, 40 is to vary the bridge to nut spacing of the strings to allow the strings to be adjusted for proper intonation. As mentioned previously, the bridge to nut spacing required for a particular string varied from one brand of string to another, but for a given string (e.g. E string or A string) of a given brand is relatively constant. The illustrated bridge is also provided with a means for visually indicating the positions of the saddles 40, 40. Therefore, the maker of the instrument can provide a printed schedule telling the user what settings of the saddles 40, 40 to use for different brands of strings or the user may make his own record of what saddle positions to use for different brands of strings.

Figure 2:
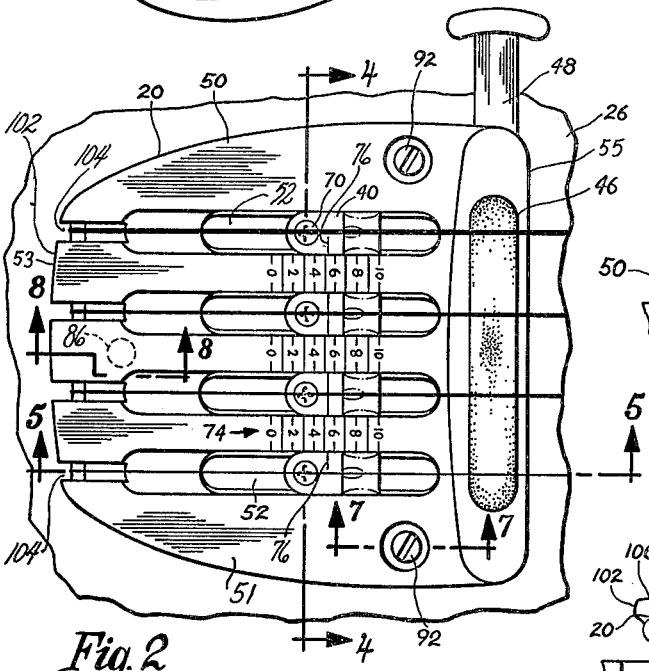
FIG. 2 is an enlarged plan view of the bridge, tailpiece and mute unit of the instrument of FIG. 1.

The saddle position indicating means is shown in FIG. 2 and consists of a set 74 of numbered graduation marks fixed to the base 50 adjacent each saddle and an associated index mark 76 carried by each saddle. Therefore, the position of the saddle can be defined by stating the number of the base graduation with which the saddle index mark 76 is to be aligned.

The base 50 is supported relative to the instrument body 26 by means which allows it to be adjusted to raise or lower the strings relative to the body and/or to tilt the base about an axis parallel to the strings. This support means includes a swivel device, shown in FIG. 8, near the rear end of the base which connects the base 50 to the body 26 so that the base is restrained to a universal movement relative to the body 26 about a point fixed relative to both the base 50 and body 26. As shown in FIG. 8, this swivel device includes a stemmed ball part 78 and a socket part 80. The socket part 80 captures a ball 82 on the upper end of the part 78 so that the parts 78 and 80 are connected to one another for universal swivelling movement about a common point 84. The socket 80 has a threaded shank 86 and is fixed to the base 50 as a result of the threaded shank 86 being tightly threadably received by the base. On its lower end, the socket part 80 has a spherical external surface which rests on a conforming surface 88 of the body 26. At its lower end, the stemmed ball part 78 threadably receives a screw 90 which is tightened sufficiently to hold the swivel device to the body 26, as a result of the wood of the body 26 being clamped between the downwardly facing spherical surface of the socket part 80 and the head of the screw 90, but which is nevertheless sufficiently loose to allow the base 50 to move relative to the body 26 about the point 84 by sliding of its lower spherical surface over the associated body bearing surface 88.

The adjustment means for the base further includes two separate height adjustment posts 92, 92 located near the forward end of the base and on opposite sides of the set of bridge slots 52, 52. Referring to FIG. 7, each height adjustment post 92 is threadably received by a metal sleeve 94 fixed to the body 26 as by press-fitting and/or adhesive. At its upper end, the post includes a spherical surface against which the lower edge of a circular opening 98 in the base 50 bears. The upper end of the post also includes a slotted head 100 received in the opening 98 and it is therefore readily acessible by a screw driver for rotating the post 92 to adjust the height of the base 50 from the body 26 along the axis of the post.

The base 50 is held against the two posts 96, 96 by the forces imposed on the base by the strings. If both of the posts are adjusted uniformly to raise or lower the base, the base will be raised or lowered at its forward end without tilting. On the other hand, if one or the other post is adjusted to raise or lower the base more than the other post, the base will be tilted about an axis parallel to the strings.

Figure 5:
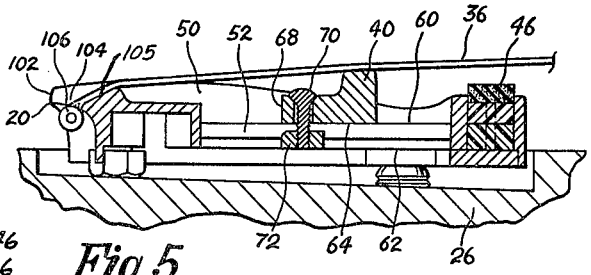
FIG. 5 is a longitudinal sectional view taken on the line 5—5 of FIG. 4.
Figure 3:
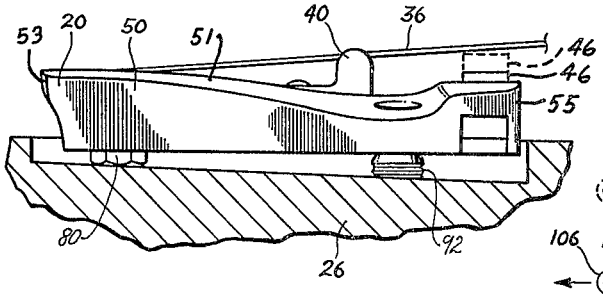
FIG. 3 is a side elevational view of the combined bridge, tailpiece and mute unit of FIG. 2 taken generally on the line 3—3 of FIG. 2.
Figure 6:
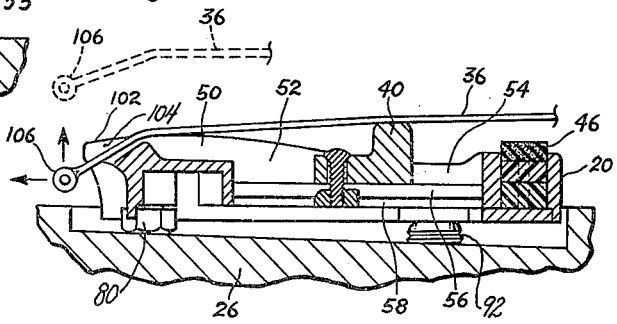
FIG. 6 is a view similar to FIG. 5 but shows the way in which a string is moved in removing it from or attaching it to the tailpiece means of the illustrated unit.
Figure 12:
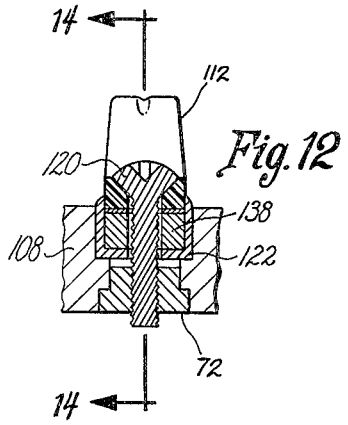
FIG. 12 is a sectional view through one of the saddles of FIG. 9 and taken on the line 12—12 of FIG. 11.
Figure 14:
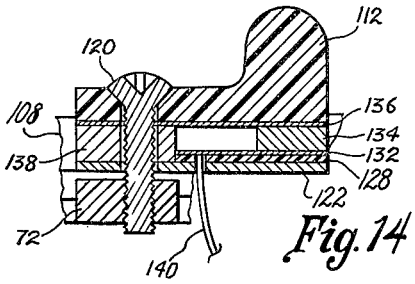
FIG. 14 is a sectional view taken on the line 14—14 of FIG. 12.
Figure 13:
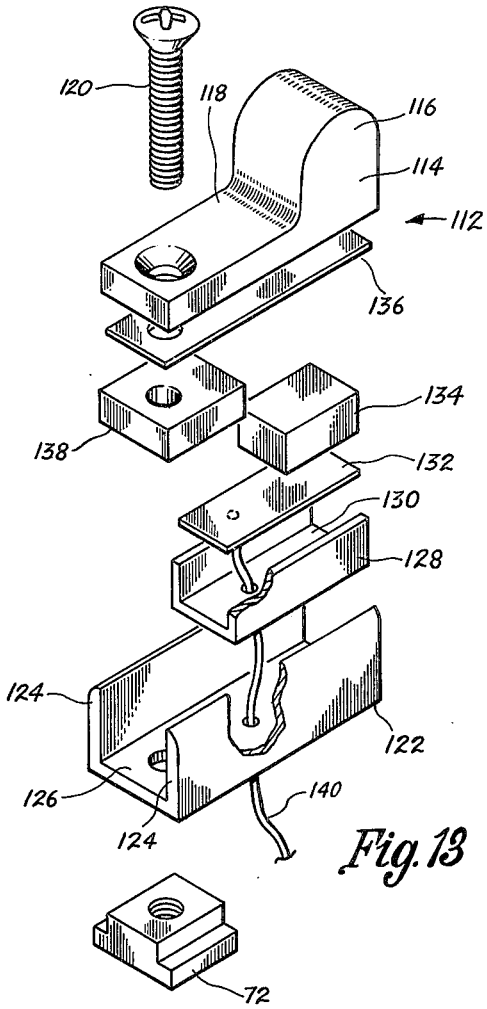
FIG. 13 is an exploded view of the saddle of FIG. 12.

The tailpiece section 38 of the unit 20, as seen best in FIGS. 2, 4 and 5, consists of a rearwardly extending lip 102 at the rear end of the base provided with a plurality of string slots 104, 104 each recessed inwardly from the top surface 51 of the base, each aligned with a respective one of the bridge slots 52 and each adapted to receive a respective one of the strings 36, 36. Each slot 104 has an open rear end and extends forwardly from such open rear end into communication with the rear end of its associated bridge slot 52. Between its open rear end and its associated bridge slot each string slot has a bottom surface, as indicated at 105 in FIG. 5, which slopes upwardly and forwardly from the undersurface of the lip 102 so as to guide the associated string forwardly toward the associated saddle without severe bending of the string in the vicinity of its beaded end. Each string slot 104 is narrower than its associated bridge slot 52. Further, each string slot has a transverse dimension greater than the diameter of the strings 36, 36 but less than the smallest size of the bead 106 attached to the end of each string. Therefore, a string may be readily attached to the tailpiece by moving it into its correct string slot 104 with its bead 106 being placed under the lip 102, and by then training it over its associated saddle 40 and forwardly to its associated machine head 34 on the peg head 32. FIG. 5 shows the illustrated string 36 in a normal state of attachment relative to the base 50. FIG. 6 in solid and broken lines shows the manner in which the string is removed from the tailpiece. In particular, from the FIG. 5 position, the string is first loosened by operation of its associated machine head until it can be moved to the solid line position of FIG. 6 at which the bead 106 can pass beyond the lip 102, and from that position it can be lifted free of the tailpiece as indicated by the broken line position of FIG. 6. To attach a string, the reverse procedure is followed.

Forwardly of the bridge slots 52, 52 is the mute section 44 including the illustrated mute 46 and mute operating slide 48. As shown best in FIGS. 5 and 6, the base 50 provides a support for these parts and includes a recess for accommodating the mute 46 and another recess for accommodating the slide 48. By movement of the slide 48, the mute 46 is movable from an inactive position out of engagement with the strings to an active position in engagement with the strings. As mentioned herebefore, the details of the mute mechanism are disclosed and described in the patent application filed simultaneously herewith and reference may be had to said application for such details.

Turning now to FIGS. 9 to 15, these figures illustrate a combined bridge, tailpiece and mute unit 22 which is similar to that of the unit 20 except for including bridge saddles with piezoelectric elements for producing electrical signals corresponding to the vibrations of the strings and except for including volume control potentiometers in the base. Referring to these figures, the unit 22 includes a base 108 which is identical with the base 50 of the unit 20 except for having four openings 110, 110 to provide access to four volume control potentiometers 111, 111 each associated with a respective one of the strings 36, 36 and each having a slotted rotatable adjustment member the slot of which is accessible by a screw driver through the associated base opening 110.

The unit 22 has four saddles 112, 112 in place of the saddles 40, 40 of the unit 20. Referring to FIGS. 11 to 14, each saddle 112 includes an upper string support part 114 made of plastic or other electrically non-conductive material having an upwardly projecting string engaging portion 116 and an arm portion 118 extending rearwardly away from the string engaging portion with a top surface located at a level below the top of the string engaging portion 116, and with an opening extending therethrough for loosely receiving a screw 120. Below the string support part 114, and having a length substantially equal to it, is an open-topped first channel member 122 of electrically conductive material having two parallel side walls 124, 124 facing one another and also having an upwardly facing valley face 126. Received in the channel member 122 and resting on its upwardly facing surface 126 is a smaller and shorter second channel member 128 made of electrically non-conductive material also open-topped and having two side walls facing one another and an upwardly facing valley surface 130. Received in the second channel member 128 and resting on its valley surface 130 is an electrical contact 132 which engages and supports the lower surface of a piezoelectric element 134. The element 134 is received between the side walls of the channel member 128 and projects just slightly above the top edges of its walls and has its upper surface engaged by a second contact 136 extending substantially the full length of the string supporting part 114. The piezoelectric element 134, the first contact 132 and the second channel member 128 are located beneath the string engaging portion 116 of the string support part 114 and terminate short of the screw 120. A spacer 138 fills the space between the contact 136 and the valley surface 128 of the first channel member in the vicinity of the screw 120 and the contact 136, spacer 138 and channel member 122 have appropriate openings for loosely receiving the screw 120 which at its lower end is threadably received by a nut 72. The structure of the saddle 112 is, therefore, one in which the piezoelectric element is substantially surrounded by grounded electrically conductive material so as to shield it against stray electric fields.

In use, the string pressing down on a string supporting part 114 of a saddle 112 presses the associated piezoelectric element 134 between the two electrical contacts 132 and 134 and develops an electrical voltage thereacross which varies with variations in the string pressure caused by the string vibration. The contact 136 is grounded through the screw 20 and/or the first channel member 122 to the base 108 and the voltage signal appearing on the contact 132 is taken therefrom by a lead 140 connected to a respective one of the potentiometers 111, 111. The potentiometers are supported by a circuit board 142 fixed to the base 108 and are located in a recess 144 defined by the base 108 between the rear ends of the bridge slots and the tailpiece lip 102.

Figure 15:
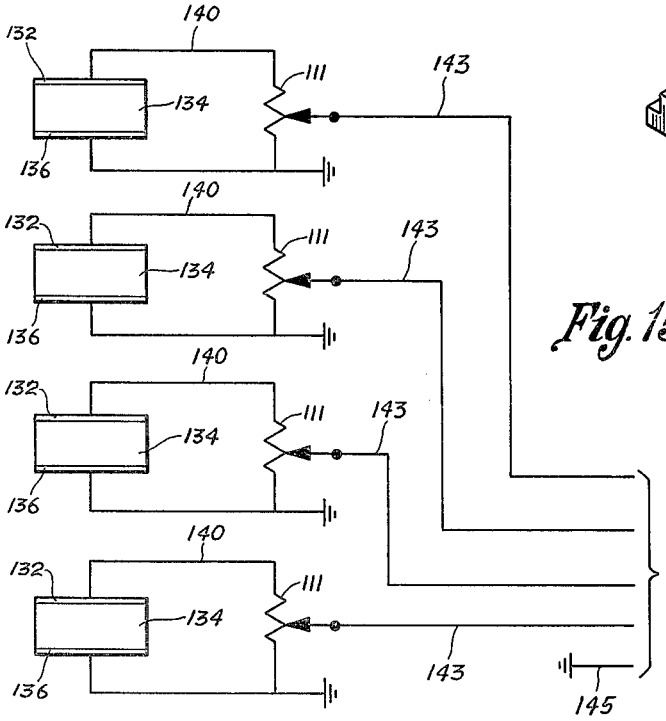
FIG. 15 is a schematic view showing the electrical circuit for the piezoelectric elements and volume control potentiometers of the unit of FIG. 9.

As shown in FIG. 15, each potentiometer 111 connects its associated lead 140 to an output lead 143 through a voltage divider circuit so as to transfer a variable amount of the signal appearing on the lead 140 to the associated lead 143. There are, therefore, four output leads 143, 143 from the unit 22 each providing a signal individually related to a respective one of the strings. The line 145 is a ground line which connects the base 50 to an external ground.

I claim:

1. A bridge for use with a stringed musical instrument having a body and a plurality of strings extending over said body, said bridge comprising: a base having forward and rear ends, means for attaching said base to a body such as aforesaid whereby said base may be adjustably raised and lowered and tilted relative to said body, a plurality of saddles each slidably received on said base for slidably movement relative to said base along an axis extending across said forward and rear ends and parallel to the strings of the instrument with which said bridge is used, each of said saddles having a portion for supporting a respective one of said strings, adjustment means for releasably fixing each of said saddles to said base at any desired position within its range of movement relative to said base, said base at its said rear end having a rearwardly projecting lip extending transversely of said axes of saddle movement, said lip having a plurality of string slots, with open rear ends, each aligned with a respective one of said saddles for anchoring bead ended strings to said base, and a mute mounted on said base forwardly of said saddles and movable relative to said base into and out of engagement with said strings, whereby said saddles, said lip with slots for anchoring said strings and said mute all retain their given positions relative to one another and move in unison with said base as said base is moved from one position of adjustment to another relative to said instrument body.

2. A bridge for use with a stringed musical instrument having a body and a plurality of strings extending over said body, said bridge comprising: a base, said base having a plurality of parallel elongated bridge slots therein arranged side by side, a plurality of saddles each slidably received in a respective one of said slots for slidable movement relative to said base along the length of said slot, each of said saddles including a portion extending out of its associated one of said slots and beyond said base for supporting a respective one of the strings of the instrument with which said bridge is used, adjustment means for releasably fixing each of said saddles to said base at any desired position within its range of movement relative to said base, a means located rearwardly of said bridge slots for connecting said base to a body of an instrument such as aforesaid so that said base is restrained to universal movement relative to said base about a point fixed relative to both said body and said base, and means located forwardly of said point of universal movement providing two transversely spaced abutments individually adjustable in height relative to a body such as aforesaid and against which said base is adapted to be held by the pressure of the strings supported by said saddles to provide with said point of universal movement a three point support for said base relative to an instrument body such as aforesaid.

3. A bridge for use with a stringed musical instrument having a body and a plurality of strings extending over said body, said bridge comprising: a base adapted for attachment to a stringed instrument body such as aforesaid, said base having a top surface, a rear end, a forward end and a plurality of parallel elongated bridge slots recessed inwardly of said top surface and arranged side by side, each of said bridge slots at its rear end terminating short of the rear end of said base and at its forward end terminating short of the forward end of said base, a plurality of saddles each having a length considerably less than the length of each of said bridge slots and each slidably received in a respective one of said bridge slots for slidable movement relative to said base along the length of said slot, each of said saddles including a portion extending out of its associated one of said bridge slots and beyond said top surface of said base for supporting a respective one of the strings of the instrument with which said bridge is used, adjustment means for releasably fixing each of said saddles to said base at any desired position within its range of movement relative to said base, said base including a upwardly opening mute recess located forwardly and extending transversely of the forward ends of said bridge slots, and a mute received in said mute recess and movable relative to said base to bring it into and out of engagement with the strings of an instrument such as aforesaid supported by said saddles.

4. A bridge as defined in claim 3 further characterized by means carried by said base and including a manually operable slide slidably supported by said base for shifting said mute between positions of engagement and nonengagement with the strings of an instrument such as aforesaid supported by said saddles.

5. A bridge for use with a stringed musical instrument having a body and a plurality of strings extending over said body, said bridge comprising: a base adapted for attachment to a stringed instrument body such as aforesaid, said base having a plurality of parallel elongated bridge slots therein arranged side by side, a plurality of saddles each slidably received in a respective one of said slots for slidable movement relative to said base along the length of said slot, each of said saddles including a portion extending out of its associated one of said slots and beyond said base for supporting a respective one of the strings of the instrument with which said bridge is used, and adjustment means for releasably fixing each of said saddles to said base at any desired position within its range of movement relative to said base, each of said bridge slots along an axis perpendicular to its length having in succession a top portion and an intermediate portion each defined by two spaced parallel side walls with the side walls of said top portion being spaced farther from one another than the side walls of said intermediate portion so as to define a pair of upwardly facing shoulders at the bottom of said top portion and a pair of downwardly facing shoulders at the bottom of said intermediate portion, the one of said saddles associated with each of said slots having a bottom surface slidably engageable with said pair of upwardly facing shoulders and a pair of parallel side faces slidably engageable with said side walls of said top slot portion, a plurality of nuts each associated with a respective one of said slots, each of said nuts having a top surface slidably engageable with said pair of downwardly facing shoulders of its associated slot, and said adjustment means including a plurality of screws each passing loosely through an associated one of said saddles and threadably received in an associated one of said nuts to fix when tightened said saddle in a given position of adjustment relative to said base by drawing said saddle and nut into tight engagement with said pairs of shoulders, each of said screws having an exposed head adapted for rotation to loosen and tighten it when making an adjustment of said saddle.

6. A bridge as defined in claim 5 further characterized by each of said bridge slots including a bottom portion located below its intermediate portion and defined by two parallel side walls spaced from one another by a distance greater than the spacing of the side walls of said intermediate portion, and each of said nuts being at least partially received in said bottom of its associated bridge slot and having two side faces slidably engageable with the side walls of said bottom slot portion.

7. A bridge as defined in claim 5 further characterized by each of said saddles including an upper string support part of electrically non-conductive material having an upwardly projecting string engaging portion and an arm portion extending away from said string engaging portion in one direction along the length of the associated one of said bridge slots, said arm portion having a top surface located at a level below the top of said string engaging portion and having an opening for said screw passing therethrough, an open-topped first channel member of electrically conductive material having two parallel side walls facing one another and an upwardly facing valley face, said string support part also having two parallel side faces and being at least partially received in the upper portion of said channel member with its side faces adjacent said side walls of said channel member, a second open-topped channel member of electrically non-conductive material received between said side walls of said first channel member and resting on said valley face of said first channel member, said second channel member being located below said string engaging portion of said string support part and having two parallel side walls facing one another, an electrical contact received in the bottom of said second channel member, a piezoelectric element located below said string engaging portion of said string support part, said piezoelectric element resting on top of said first electrical contact and located between said side walls of said second channel member, and a second electrical contact resting on top of said piezoelectric element and having said string support part resting on it.

8. A bridge as defined in claim 7 further characterized by said first channel member having a screw opening aligned with that of said arm portion of said string support part, said second channel member and said first electrical and said piezoelectric element all terminating short of said screw opening in said arm portion of said string support part, said second contact extending along the length of said arm portion of said string support part and having a screw opening aligned with that of said arm portion, and a spacer received between said side walls of said first channel member, said spacer being located between said second contact and said valley face of said first channel member and having a screw opening aligned with that of said arm portion of said string support part.

9. A bridge for use with a stringed musical instrument having a body and a plurality of strings extending over said body, said bridge comprising: a base adapted for attachment to a stringed instrument body such as aforesaid, said base having a top surface, a rear end, a forward end and a plurality of parallel elongated bridge slots recessed inwardly of said top surface and arranged side by side, each of said bridge slots at its rear end terminating short of the rear end of said base and at its forward end terminating short of the forward end of said base, a plurality of saddles each having a length considerably less than the length of each of said bridge slots and each slidably received in a respective one of said bridge slots for slidable movement relative to said base along the length of said slot, each of said saddles including a portion extending out of its associated one of said bridge slots and beyond said top surface of said base for supporting a respective one of the strings of the instrument with which said bridge is used, adjustment means for releasably fixing each of said saddles to said base at any desired position within its range of movement relative to said base, said base at its rear end and rearwardly of said bridge slots having a rearwardly projecting lip extending transversely of said bridge slots, said lip having a plurality of string slots with open rear ends, each aligned with a respective one of said bridge slots, for anchoring bead ended strings to said base, each of said string slots being narrower than its associated one of said bridge slots and each of said string slots being recessed inwardly of said top surface of said base, each of said string slots further between its open rear end and its associated bridge slot having a bottom surface sloping upwardly and forwardly from the undersurface of said lip, each of said saddles including a piezoelectric element for converting the vibration of the string supported by it into an analogous electrical signal, said saddles each having a first electrical output lead for its piezoelectric element, said base having a top wall in an area adjacent said slots and a control recess located below said top wall, a plurality of second output leads communicating with said recess, and a plurality of volume controls in said recess each connected between a respective one of said first output leads and a respective one of said second output leads for supplying a variable amount of the electrical signal appearing on its associated first output lead to its associated second output lead.

10. A bridge as defined in claim 9 further characterized by each of said volume controls being a potentiometer with a rotatable adjustment part adapted to receive a tool for rotating it, and a plurality of holes in said top wall of these base aligned with said rotatable parts of said potentiometers to permit access of a tool to said parts for adjustment of said potentiometers.

11. A bridge as defined in claim 9 further characterized by said control recess being located rearwardly of the rear ends of said bridge slots, and said base rearwardly of said control recess including a rearwardly projecting lip extending transversely of said bridge slots, said lip having a plurality of string receiving slots with open rear ends, each aligned with a respective one of said bridge slots, for anchoring bead ended strings to said base.

* * * * *